US005232809A

United States Patent [19]

Anzai et al.

[11] Patent Number: 5,232,809

[45] Date of Patent: Aug. 3, 1993

[54] TONER FOR ELECTROPHOTOGRAPHY

[75] Inventors: Mitsutoshi Anzai; Noboru Akuzawa; Yuuji Matsuura; Kayoko Watanabe, all of Tokyo, Japan

[73] Assignee: Hodogaya Chemical Co., Ltd., Tokyo, Japan

[21] Appl. No.: 811,540

[22] Filed: Dec. 20, 1991

[51] Int. Cl.[5] ..... G03G 9/135

[52] U.S. Cl. ..... 430/110

[58] Field of Search ..... 430/106, 110

[56] References Cited

U.S. PATENT DOCUMENTS

| | | | |
|---|---|---|---|
| 4,824,751 | 4/1989 | Matuura et al. | 430/106 |
| 4,845,003 | 7/1989 | Kiriu et al. | 430/110 |
| 5,045,425 | 9/1991 | Swidler | 430/115 |

*Primary Examiner*—John Goodrow

*Attorney, Agent, or Firm*—Wegner, Cantor, Mueller & Player

[57] ABSTRACT

Provided is a toner for electrophotography, comprising a binder resin, a colorant and a charge control agent; said charge control agent comprising an aluminum compound represented by the following formula:

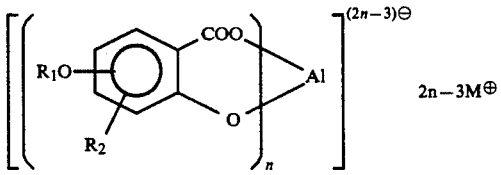

(1)

wherein $R_1$ represents an alkyl group, a cycloalkyl group or an aralkyl group; $R_2$ represents a hydrogen atom, an alkyl group, a cycloalkyl group, an aralkyl group, an aryl group, a hydroxyl group or an alkoxyl group; n represents an integer of 2 or 3; and M represents a hydrogen atom, an alkali metal, or an ammonium, aliphatic ammonium or alicyclic ammonium ion.

11 Claims, No Drawings

TONER FOR ELECTROPHOTOGRAPHY

BACKGROUND OF THE INVENTION

1. Field of the Invention

The present invention relates to a toner for electrophotography, used for developing an electrostatic latent image in electrophotography, static recording, etc.

2. Related Background Art

In processes for forming images by the use of electrophotographic systems, an electrostatic latent image is formed on an inorganic photoconductor comprised of selenium, a selenium alloy, cadmium sulfide, amorphorous silicon or the like or an organic photoconductor making use of a charge-generating material and a charge-transporting material, which is then developed using a toner, and transferred to a sheet such as paper or plastic film, followed by fixing to obtain a visible image. The photosensitive member can be constituted to have either a positive chargeability or a negative chargeability. In the case when print areas are left as an electrostatic latent image as a result of exposure, development is carried out using an opposite-sign chargeable toner. On the other hand, in the case when print areas are charge-eliminated to effect reversal development, the development is carried out using a same-sign chargeable toner. Toners are comprises of a binder resin, a colorant and other additives, where a charge control agent is commonly used so that desired triboelectric characteristics such as charge up speed, charge level and charge stability or storage stability and environmental stability can be imparted to the toners. This charge control agent greatly influences the characteristics of toners. Negatively chargeable toners are used in the case when development is carried out using the opposite-sign chargeable toner by the use of a positively chargeable photosensitive member and also in the case when reversal development is carried out by the use of a negatively chargeable photoconductor, and negative charge control agents are used in such cases.

In the case of color toners, it is necessary to use pale, preferably colorless, charge control agents that do not adversely affect hues. Such pale, or colorless, charge control agents include, for example, metal complex compounds of hydroxybenzoic acid derivatives as disclosed in Japanese Patent Publication No. 55-42752, Japanese Patent Application Laid-open No. 61-69073 and No. 61-221756, etc.; metal aromatic dicarboxylate compounds as disclosed in Japanese Patent Application Laid-open No. 57-111541; metal complex compounds of anthranilic acid derivatives as disclosed in Japanese Patent Application Laid-open No. 61-141453, No. 62-94856, etc.; organic boron compounds as disclosed in U.S. Pat. No. 4,767,688, Japanese Patent Application Laid-open No. 1-306861, etc.; and biphenol compounds as disclosed in Japanese Patent Application Laid-open No. 61-3149. These charge control agents, however, have disadvantages such that they are chromium compounds having a possibility of environmental pollution, they are materials that can not be perfectly colorless, or they have a low charge-providing effect, give inversely charged toners and have a poor dispersibility or stability. Thus, none of conventional charge control agents have a satisfactory performance.

SUMMARY OF THE INVENTION

An object of the present invention is to provide a toner using as the charge control agent an aluminum compound having a high stability required for compounds, which charge control agent has a good dispersibility to binder resins, has a good triboelectric charge stability and can always stably give images with a high image quality.

The present inventors have discovered a colorless stable compound having a good dispersibility to binder resins and capable of imparting good charge characteristics to toners, and used it as the charge control agent. Thus they have invented an excellent toner.

That is, the present invention is a toner for electrophotography, comprising a binder resin, a colorant and a charge control agent; said charge control agent comprising an aluminum compound represented by the following formula:

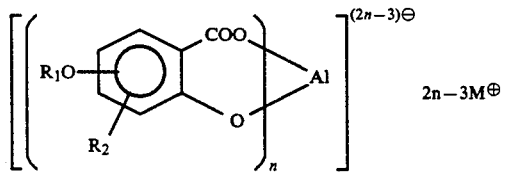

(1)

wherein $R_1$ represents an alkyl group, a cycloalkyl group or an aralkyl group; $R_2$ represents a hydrogen atom, an alkyl group, a cycloalkyl group, an aralkyl group, an aryl group, a hydroxyl group or an alkoxyl group; n represents an integer of 2 or 3; and M represents a hydrogen atoms, an alkali metal, or an ammonium, aliphatic ammonium or alicyclic ammonium ion.

DETAILED DESCRIPTION OF THE PREFERRED EMBODIMENTS

The present invention s a toner basically comprised of a binder resin, a colorant and the compound according to the present invention, represented by Formula (1). The toner of the present invention can be produced by a method in which a mixture of the above materials is kneaded using a heat-mixing apparatus while the binder resin is in a molten state, and then the kneaded product is cooled, followed by crushing, pulverizing and classification to give a toner; a method in which the above materials are dissolved in a solvent and the solution is sprayed into fine particles, followed by drying and classification to give a toner; or a method in which a colorant and the compound represented by Formula (1) are dispersed in suspended monomer particles, followed by polymerization to give a toner.

Alkyl radicals $R_1$ and $R_2$ in the formula (1) can be straight chain or branched. Examples of alkyl radicals are methyl, ethyl, n-propyl, iso-propyl, n-butyl, sec-butyl, amyl, pentyl, n-hexyl, 2-ethyl-hexyl, n-octyl, iso-octyl, decyl or n-dodecyl, preferably methyl.

Cycloalkyl radicals $R_1$ and $R_2$ in the formula (1) are for example cyclopentyl, cyclohexyl or cyclooctyl, preferably cyclohexyl.

Aralkyl radicals $R_1$ and $R_2$ in the formula (1) are for example benzyl, phenethyl or methylbenzyl, preferably benzyl.

Aryl radical $R_2$ in the formula (1) is for example phenyl or naphthyl.

Alkoxyl radical $R_2$ in the formula (1) is for example methoxy, ethoxy, butoxy, pentoxy or hexyloxy, preferably methoxy.

Alkali metal M in the formula (1) is for example sodium, potassium or lithium, preferably potassium.

Aliphatic ammonium M in the formula (1) is for example methyl ammonium, ethyl ammonium or propyl ammonium, preferably methyl ammonium.

Alicyclic ammonium M in the formula (1) is for example cyclopentyl ammonium, cyclohexyl ammonium, which are unsubstituted or substituted by one or more methyl groups.

For an ammonium ion, heterocyclic amines such as pyrrolidine, pyrazoline, imidazoline, piperidine, piperazine, morpholine and so on can also be used.

The binder resin may include polystyrene, a styrene/methacrylate copolymer, a styrene/propylene copolymer, a styrene/butadiene copolymer, acrylic resins, a styrene/maleic acid copolymer, olefin resins, polyesters, epoxy resins, polyurethane resins and polyvinyl butyral, which can be used alone or in the form of a mixture.

As the colorant, carbon black is commonly used for black toners. For color toners, the following colorants can be used. As yellow colorants, usable are axo type organic pigments such as C. I. Pigment Yellow 1, C. I. Pigment Yellow 5, C. I. Pigment Yellow 12 and C. I. Pigment Yellow 17, inorganic pigments such as yellow ocher, or oil-soluble dyes such as C. I. Solvent Yellow 2, C. I. Solvent Yellow 6, C. I. Solvent Yelow 14 and C. I. Solvent Yellow 19; as magenta colorants, azo pigments such as C. I. Pigment Red 57 and C. I. Pigment Red 57;1, xanthene pigments such as C. I. Pigment Violet 1 and C. I. Pigment Red 81, thioindigo pigments such as C. I. Pigment Red 87, C. I. Vat Red 1 and C. I. Pigment Violet 38, or oil-soluble dyes such as C. I. Solvent Red 19, C. I. Solvent Red 49 and C. I. Solvent Red 52; as cyan colorants, triphenylmethane pigments such as C. I. Pigment Blue 1, phthalocyanine pigments such as C. I. Pigment Blue 15 and C. I. Pgiment Blue 17, or oil-soluble dyes such as C. I. Solvent Blue 25, C. I. Solvent Blue 40 and C. I. Solvent Blue 70; all of which are known in the art.

The aluminum compound according to the present invention, usable as the charge control agent, can be exemplified by the following:

| No. | Exemplary Compounds |
|---|---|
| (1) | 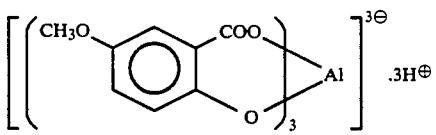 |
| (2) | 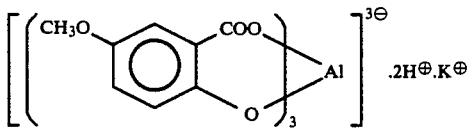 |
| (3) | 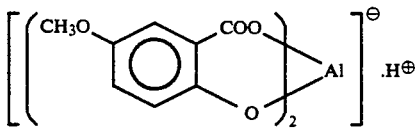 |
| (4) | 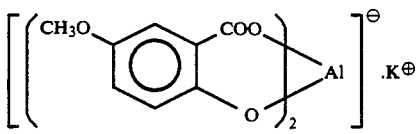 |

-continued

| No. | Exemplary Compounds |
|---|---|
| (5) | 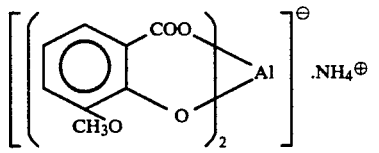 |
| (6) | 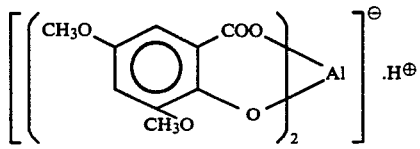 |
| (7) | 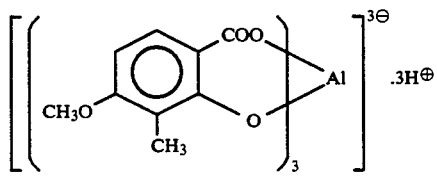 |
| (8) | 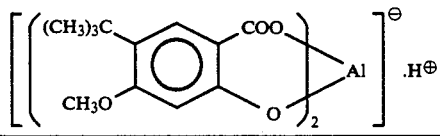 |

The toner may optionally be incorporated with additives such as hydrophobic silica, metal soap, a fluorine-containing surface active agent, dioctyl phthalate, wax, tin oxide and conductive zinc oxide for the purposes of, e.g., protecting photosensitive members and carriers, improving fluidity of toners, adjusting thermal properties, electrical properties and physical properties, adjusting resistance, adjusting softening points, and improving fixing performance.

In instances in which the toner of the present invention is used in two-component developers, a carrier is used which may include fine glass, iron powder, ferrite powder, binder type carriers comprised of resin particles in which magnetic particles have been dispersed, and resin-coated carriers whose particle surfaces have been coated with a polyester resin, a fluorine resin, an acrylic resin, a silicone resin or the like. The toner of the present invention can exhibit excellent performances also when used as one-component toners.

The present invention will be specifically described below by given Examples. In the following, "part(s)" indicates "part(s) by weight".

EXAMPLE 1

Using a heat-mixing apparatus, 1 part of the aluminum compound of exemplary compound (1), 5 parts of carbon black and 94 parts of a styrene/ethylhexyl methacrylate copolymer were kneaded, and then the kneaded product was cooled, followed by crushing using a hammer mill. The crushed product was pulverized using a jet mill, followed by classification to give a black toner with particle diameters of from 10 to 12 μm. This toner was mixed with iron powder carrier in a weight proportion of 4:100, and the mixture was shaken. As a result, the toner was negatively charged. Measurement using a blow-off powder charge measuring apparatus revealed that the charge was in a quantity of −15

μc/g. Using this toner, images were reproduced using a modified, commercially available copier. As a result, it was possible to obtain images with a sharp image quality at the initial stage and even after 10,000 sheet running.

EXAMPLE 2

Using a heat-mixing apparatus, 1 part of the aluminum compound of exemplary compound (2), 5 parts of carbon black and 94 parts of a styrene/ethylhexyl methacrylate copolymer were kneaded, and then the kneaded product was cooled, followed by crushing using a hammer mill. The crushed product was pulverized using a jet mill, followed by classification to give a black toner with particle diameters of from 10 to 12 μm. This toner was mixed with iron powder carrier in a weight proportion of 4:100, and the mixture was shaken. As a result, the toner was negatively charged. Measurement using a blow-off poser charge measuring apparatus revealed that the charge was in a quantity of −14 μc/g. Using this toner, images were reproduced using a modified, commercially available copier. As a result, it was possible to obtain images with a sharp image quality at the initial stage and even after 10,000 sheet running.

EXAMPLE 3

Using a heat-mixing apparatus, 1 part of the aluminum compound of exemplary compound (1), 5 parts of a phthalocyanine oil-soluble dye SPIRON BLUE 2BNH (trade name; available from Hodogaya Chemical Co., Ltd.; C. I. Solvent Blue 70) and 94 parts of a styrene/butyl methacrylate copolymer were kneaded, and then the kneaded product was cooled, followed by crushing using a hammer mill. The rushed product was pulverized using a jet mill, followed by classification to give a blue toner with particle diameters of from 10 to 12 μm. This toner was mixed with iron powder carrier in a weight proportion of 4:100, and the mixture was shaken. As a result, the toner was negatively charged. Measurement using a blow-off powder charge measuring apparatus revealed that the charge was in a quantity of −18 μc/g. Using this toner, images were reproduced using a modified, commercially available copier. As a result, it was possible to obtain images with a sharp image quality at the initial stage and even after 10,000 sheet running.

EXAMPLE 4

Using a heat-mixing apparatus, 1 part of the aluminum compound of exemplary compound (3), 5 parts of carbon black and 94 parts of a styrene/ethylhexyl methacrylate copolymer were kneaded, and then the kneaded product was cooled, followed by crushing using a hammer mill. The crushed product was pulverized using a jet mill, followed by classification to give a black toner with particle diameters of from 10 to 12 μm. This toner was mixed with silicon resin-coated carrier in a weight proportion of 4:100, and the mixture was shaken. As a result, the toner was negatively charged. Measurement using a blow-off powder charge measuring apparatus revealed that the charge was in a quantity of −15 μc/g. Using this toner, images were reproduced using a modified, commercially available copier. As a result, it was possible to obtain images with a sharp image quality at the initial stage and even after 10,000 sheet running.

EXAMPLE 5

Using a heat-mixing apparatus, 1 part of the aluminum compound of exemplary compound (3), 5 parts of carbon black and 94 parts of a polyester resin (trade name: NICHIGO POLYESTER HP-320; available from Nihon Gosei Chemical Co., Ltd.) were kneaded, and then the kneaded product was cooled, followed by crushing using a hammer mill. This crushed product was pulverized using a jet mill, followed by classification to give a black toner with particle diameters of from 10 to 12 μm. This toner was mixed with iron powder carrier in a weight proportion of 4:100, and the mixture was shaken. As a result, the toner was negatively charged. Measurement using a blow-off powder charge measuring apparatus revealed that the charge was in a quantity of −15 μc/g. Using this toner, images were reproduced using a modified, commercially available copier. As a result, it was possible to obtain images with a sharp image quality at the initial stage and even after 10,000 sheet running.

EXAMPLES 6 to 11

Example 1 was repeated except that the aluminum compound of exemplary compound (1) used therein was replaced with the aluminum compound as shown in Table 1. Results also shown in Table 1 were obtained.

TABLE 1

| Example | Aluminum compound | Charge of toner (−μc/g) | Image quality: Initial stage | Image quality: 10,000 sh. running |
|---|---|---|---|---|
| 6 | Ex. compound (3) | 19 | Sharp | Sharp |
| 7 | Ex. compound (4) | 17 | " | " |
| 8 | Ex. compound (5) | 15 | " | " |
| 9 | Ex. compound (6) | 18 | " | " |
| 10 | Ex. compound (7) | 20 | " | " |
| 11 | Ex. compound (8) | 22 | " | " |

What is claimed is:

1. A toner for electrophotography, comprising a binder resin, a colorant and a charge control agent; said charge control agent comprising an aluminum compound represented by the following formula:

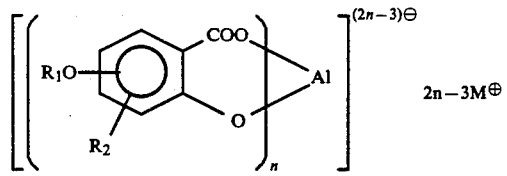

(1)

wherein $R_1$ represents an alkyl group, a cycloalkyl group or an aralkyl group; $R_2$ represents a hydrogen atom, an alkyl group, a cycloalkyl group, an aralkyl group, an aryl group, a hydroxyl group or an alkoxyl group; n represents an integer of 2 or 3; and M represents a hydrogen atom, an alkali metal, or an ammonium, aliphatic ammonium or alicyclic ammonium ion.

2. A toner for electrophotography according to claim 1, wherein $R_1$ in the formula (1) is an alkyl group.

3. A toner for electrophotography according to claim 1, wherein $R_2$ in the formula (1) is hydrogen, an alkyl group or an alkoxyl group.

4. A toner for electrophotography according to claim 1, wherein $R_1$ in the formula (1) is methyl.

5. A toner for electrophotography according to claim 1, wherein $R_2$ in the formula (1) is hydrogen, methyl, methoxy or tert-butyl.

6. A toner for electrophotography according to claim 1, wherein $R_1$ in the formula (1) is methyl, $R_2$ is hydrogen, methyl or methoxy and M is hydrogen, an alkali metal or an ammonium ion.

7. A toner for electrophotography according to claim 1, wherein M in the formula (1) is an alkali metal or an ammonium ion.

8. A toner for electrophotography according to claim 1, wherein M in the formula (1) is potassium.

9. A toner for electrophotography according to claim 1, wherein n in the formula (1) is 2.

10. A toner for electrophotography according to claim 6, wherein n in the formula (1) is 2.

11. A toner for electrophotography according to claim 1, wherein $R_1$ is methyl, $R_2$ is hydrogen, n is 2 and M is hydrogen, in the formula (1), respectively.

* * * * *